US006383340B1

(12) United States Patent
Meschenmoser

(10) Patent No.: US 6,383,340 B1
(45) Date of Patent: May 7, 2002

(54) PRESS ARRANGEMENT AND PROCESS

(75) Inventor: Andreas Meschenmoser, Horgenzell (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/489,907

(22) Filed: Jan. 24, 2000

(30) Foreign Application Priority Data

Feb. 4, 1999 (DE) ..... 199 04 576

(51) Int. Cl.[7] ..... D21F 3/00

(52) U.S. Cl. ..... 162/360.3; 162/358.1; 162/358.3; 162/202; 162/203; 162/204; 162/205

(58) Field of Search ..... 162/360.3, 358.1, 162/358.3, 202, 203, 204, 205

(56) References Cited

U.S. PATENT DOCUMENTS

| | | | | |
|---|---|---|---|---|
| 4,586,984 A | | 5/1986 | Laapotti | |
| 5,256,257 A | * | 10/1993 | Schiel | 162/360.3 |
| 5,833,810 A | | 11/1998 | Laapotti | |
| 5,865,954 A | | 2/1999 | Laapotti | |
| 5,868,904 A | | 2/1999 | Laapotti | |
| 6,200,427 B1 | | 3/2001 | Kotitschke et al. | |

FOREIGN PATENT DOCUMENTS

| | | |
|---|---|---|
| DE | 3410171 | 9/1984 |
| DE | 92033954 | 6/1992 |
| DE | 19633958 | 10/1997 |
| DE | 19654282 | 6/1998 |
| DE | 19713645 | 10/1998 |
| DE | 29811048 | 10/1998 |
| DE | 19724218 | 12/1998 |
| DE | 19802853 | 7/1999 |

* cited by examiner

*Primary Examiner*—Stanley S. Silverman
*Assistant Examiner*—Mark Halpern
(74) *Attorney, Agent, or Firm*—Greenblum & Bernstein, P.L.C.

(57) ABSTRACT

Press arrangement and process for treating a fibrous material web that includes two shoe press rolls and a counter-roll, associated with the two shoe press rolls, positioned to form a first and a second press nip with the two shoe press rolls. The first and the second press nip are elongated in a web travel direction. The press arrangement also includes a plurality of felts, such that two of the plurality of felts are guided through at least the first press nip. The process includes transferring the web onto a pick-up felt, in which the pick-up felt is one of the two felts guided through at least the first press nip, and dewatering the web between the two felts in the first elongated press nip.

29 Claims, 3 Drawing Sheets

PRESS ARRANGEMENT AND PROCESS

CROSS-REFERENCE TO RELATED APPLICATIONS

The present application claims priority under 35 U.S.C. § 119 of German Patent Application No. 199 04 576.3, filed on Feb. 4, 1999, the disclosure of which is expressly incorporated by reference herein in its entirety.

BACKGROUND OF THE INVENTION

FIELD OF THE INVENTION

The present invention relates to a press arrangement and process for treating a fibrous material web, e.g., a paper or cardboard web.

SUMMARY OF THE INVENTION

The present invention provides a press arrangement of the type generally discussed above, which also has a simple and compact design, as well as vacuum requirements and drive output that are as small as possible. In addition, closed web guidance system is possible.

Therefore, the present invention provides two shoe press rolls assigned to a central press roll, which acts as a shared counter-roll. In this way, the shoe press rolls, along with the central roll, can be arranged to form press nips that are elongated in the web travel direction. Further, the first elongated press nip, as viewed in the web travel direction, is provided with two felts.

With this design, the conventional, large suction press provided with a thick jacket can be omitted which in turn appreciably reduces the vacuum requirements. Thus, there is an overall appreciably smaller power requirement. In particular, it becomes easy to provide the web with a closed guidance system, so that the corresponding press section is particularly suitable for liners with a "white top." By using an opposing roll assigned to the two shoe press rolls, the number of needed press rolls is also reduced to the minimum, i.e., a maximum of only three press rolls is required. Accordingly, the number of necessary press felts is also reduced, and this reduced felt consumption lowers operating costs. Operating costs are further reduced by the lower vacuum requirement for tube suction devices and by the lower power requirement.

In particular, an arrangement becomes possible in which the press forces for the most part counterbalance each other. Furthermore, there is a reduced bearing load and a reduced bending load on the roll axle, and it is possible to eliminate an inwardly supported roll, if need be, for all machine widths. The decreased energy consumption is in part due to the fact that, with only one opposing roll assigned to the shoe press rolls, the lower bearing friction lessens the amount of friction created within the press arrangement. The reduction in the number of felts thereby reduces felt reconditioning, which further reduces friction and the vacuum requirement. Losses caused by rolls that are inwardly supported are eliminated, and only a single drive outside of the given paper machine is necessary, which results in improved efficiency. When the number of employed rolls and roll types are reduced to a minimum, the number of reserve rolls needed also becomes low, which in turn has a favorable effect on investment costs. Moreover, a simpler control system becomes possible, which thereby increases operating safety. Compared to conventional multi-roll presses, the line of force is not affected by reciprocal nip forces, and camberings become largely unnecessary. It is also no longer necessary to use soft roll covers, which results in longer tool lives. A varying degree of pull on the paper is practically eliminated. Consequently, it is possible to avoid web tears within the press section. In particular, it is possible to have a simpler, lever-free, and compact support with a closed flow of force. With the elimination of press roll scrapers for paper removal, the investment and operating costs are further diminished.

The two shoe press rolls can preferably be positioned on opposite sides of the central press roll.

In an exemplary embodiment of the press arrangement according to the instant invention, each of the two elongated press nips are provided with two felts. Overall, this provides symmetrical dewatering that also affords a savings in terms of volume. In paper manufacturing, the equal-sidedness of the paper is particularly improved, so that the press arrangement can also be used for graphic papers.

In another exemplary embodiment of the press arrangement according to the invention, a total of at most three felts is provided. A felt can be guided through both elongated press nips. Only three felt treatments are therefore necessary which in turn reduces the creation of friction as well as the vacuum requirement. There is a reduced total felt consumption. Overall, a compact and cost-effective design is possible. Not only can the suction press roll be omitted, but a closed web guidance and relatively short remoistening zones are possible. Good nip dewatering is provided after each nip, which can be achieved by, e.g., centrifugal water removal.

A highly reliably transport of the web can be achieved with a closed web guidance system from the screen to the drier section, and the press arrangement practically eliminates tears in the web. Furthermore, the manual setup of the fibrous material web is eliminated, which results in a higher degree of operating safety and greater machine availability. Moreover, due to the absence of open pulls, it is practically impossible to have paper stretching and/or web tears. There are also no fluctuations in pull on the paper between the presses.

Between the two elongated press nips formed with the central press roll, the fibrous material web, along with a felt, can ideally be guided around a deflection roll preferably designed as a suction roll.

In a useful practical embodiment, a felt guided through the first elongated press nip simultaneously serves as a pick-up felt.

It is also advantageous for the fibrous material web, following the second elongated press nip, to be guided over a deflection roll in the form of a suction roll, e.g., to an adjacent drier section. Here, the fibrous material web can be conducted around the deflection roll, along with an upper felt running through the second elongated press nip, and then be removed from the upper felt by a smooth roll. As an alternative, it is possible, e.g., to guide the fibrous material web, along with a lower felt, out of the second elongated press nip and to remove it from the lower felt in the area of the deflection roll, specifically with a drying screen which wraps around the deflection roll.

The surface of the central press roll and/or the press jacket of at least one shoe press roll can be blind-bored and/or grooved in order to create a certain water storage capability. In this way, the dewatering of one or both elongated press nips can be performed at least in part by centrifuging the water through a given groove. This not only assures the optimal dewatering of the given press nip, but can enable the use of lighter press felts. Finally, improved felt conditioning via tube suction devices and spray tubes may be provided.

In certain cases it may be useful for the support devices assigned to the press shoes of the two shoe press rolls to be able to be subjected to the same pressures. Here, it will be more effective for the length of the first elongated press nip to be greater than the length of the second elongated press nip. In particular, it is possible to have equal line forces. In an alternative embodiment, the supporting device assigned to the press shoe of the first shoe press roll can be subjected to a lower pressure than the supporting device assigned to press shoe of the second shoe press roll. In this case, it will be effective for the two elongated press nips to have the same length. Here in particular, the line force of the second elongated press nip can be greater than that of the first elongated press nip.

For reasons of weight, it may be useful for the central press roll to be an inwardly supported roll and to be provided with the pressures assigned to each of the press nips.

In order to influence the felt tension between the two elongated press nips, it may be advantageous for the deflection roll to have an adjustable drive.

Accordingly, the present invention is directed to a press arrangement for treating a fibrous material web that includes two shoe press rolls and a counter-roll, associated with the two shoe press rolls, positioned to form a first and a second press nip with the two shoe press rolls. The first and the second press nip are elongated in a web travel direction. The press arrangement also includes a plurality of felts, such that two of the plurality of felts are guided through at least the first press nip.

In accordance with a feature of the invention, the two shoe press rolls may be positioned on opposite sides of the counter-roll.

According to another feature of the present invention, two of the plurality of felts may be guided through the second press nip.

According to a further feature of the invention, the plurality of felts can at most three felts.

In accordance with still another feature of the invention, the press arrangement can be a closed web guidance system.

In accordance with another feature of the invention, one of the plurality of felts may be guided through both of the first and the second press nips.

A deflection roll may be positioned such that the material web, between the first and the second press nip, is guided around the deflection roll. The deflection roll can include a suction roll, and the material web may be guided over the deflection roll by at least one of the plurality of felts.

In accordance with still another feature of the present invention, one of the plurality of felts guided through the first press nip can also arranged as a pick-up felt.

A deflection roll can be provided, such that, following the second press nip, the fibrous material web can be guided by the deflection roll. The deflection roll can include a suction roll, and the deflection roll can be arranged to guide the fibrous material web to an adjacent dryer section. A smooth roll may also be provided, and one of the plurality of felts may be arranged as an upper felt and may be guided through the second press nip. The smooth roll can be arranged to separate the material web from the upper felt. Moreover, a dryer screen that wraps around the deflection roll can be provided, and another one of the plurality of felts may be arranged as a lower felt and can be arranged to guide the fibrous material web out of the second press nip. The dryer screen may be positioned to separate the fibrous material web form the lower felt in a vicinity of the deflection roll.

The counter-roll can be at least one of blind-bored and grooved.

At least one of the counter-roll and at least one jacket of the two shoe press rolls can include at least one of at least one bore and at least one groove. Further, dewatering of the first and the second press nip may be performed at least in part by spinning off water in the at least one at least one bore and at least one groove.

In accordance with a particular feature of the instant invention, each of the two press shoe rolls can include at least one press shoe and at least one supporting device associated with the at least one press shoe, and a length of the at least one press shoe forming the first press nip may be greater than a length of the at least one press shoe forming the second press nip. A same pressure can be applied to the at least one supporting device in both of the two shoe press rolls.

According to another particular feature of the instant invention, each of the two press shoe rolls can include at least one press shoe and at least one supporting device associated with the at least one press shoe, and a length of the at least one press shoe forming the first press nip may be the same as a length of the at least one press shoe forming the second press nip. A pressure applied to the at least one supporting device adapted to form the first press nip may be lower than a pressure applied to the at least one supporting device adapted to form the second press nip.

According to another feature of the instant invention, at least one of the two shoe press rolls can include at least one of a blind-bored and grooved press jacket.

In accordance with still another feature of the present invention, the counter-roll can be an inwardly supported roll with pressures corresponding to pressures in the first and the second press nips.

According to a further feature of the invention, an aspirating deflection roll and a web-supporting aspirator may be provided. The web-supporting aspirator can be positioned between the aspirating deflection roll and the second press nip, and one of the plurality of felts can be arranged as a lower felt, so that the web-supporting aspirator is positioned to secure the fibrous material web to the lower felt. The aspirated deflection roll can have an adjustable drive. Further, the aspirated deflection roll and the adjustable drive can also be braked, whereby felt tension is increased in front of the second press nip.

In accordance with another feature of the present invention, the fibrous material web may include one of a paper web and a cardboard web. Further, the counter-roll can be arranged as a central press roll.

The present invention is also directed to a process for treating a fibrous material web in an apparatus that includes two shoe press rolls, a counter-roll, associated with the two shoe press rolls, that is positioned to form a first and a second elongated press nip in a web travel direction with the two shoe press rolls, and a plurality of felts, in which two of the plurality of felts are guided through at least the first elongated press nip. The process includes transferring the web onto a pick-up felt, where the pick-up felt is one of the two felts guided through at least the first press nip, and dewatering the web between the two felts in the first elongated press nip.

In accordance with a feature of the invention, the apparatus includes two of the plurality of felts being guided through the second elongated press nip, and the process may further include dewatering the web between the two felts in the second elongated press nip. Further, the process can include guiding the fibrous material web through the first and second elongated press nips with a same felt.

According to another feature of the invention, each shoe press roll includes at least one press shoe and at least one supporting device associated with each at least one press shoe, and a length of the at least one press shoe forming the first elongated press nip is greater than a length of the at least one press shoe forming the second elongated press nip. In this manner, the process may further include applying a same pressure to the at least one supporting device in both of the two shoe press rolls.

In accordance with still another feature of the instant invention, each shoe press roll includes at least one press shoe and at least one supporting device associated with each at least one press shoe, and a length of the at least one press shoe forming the first elongated press nip is the same as a length the at least one press shoe forming the second elongated press nip. In this manner, the process may further include applying a pressure to the at least one supporting device adapted to form the first press nip that is lower than a pressure applied to the at least one supporting device adapted to form the second press nip.

According to yet another feature of the present invention, the process can further include adjusting a felt tension prior to the second elongated press nip.

The present invention is also directed to a press arrangement for treating a fibrous material web including two shoe press rolls and a counter-roll, associated with the two shoe press rolls, positioned to form a first and a second press nip with the two shoe press rolls. The first and the second press nip are elongated in a web travel direction, and the counter-roll is arranged as a central press roll. Three felts, in which two of the three felts are guided through at least the first nip, in which two of the three felts are guided through the second press nip, and in which one of the three felts is guided through both of the first and the second press nips. The two shoe press rolls are positioned on opposite sides of the counter-roll, and the press arrangement is a closed web guidance system.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
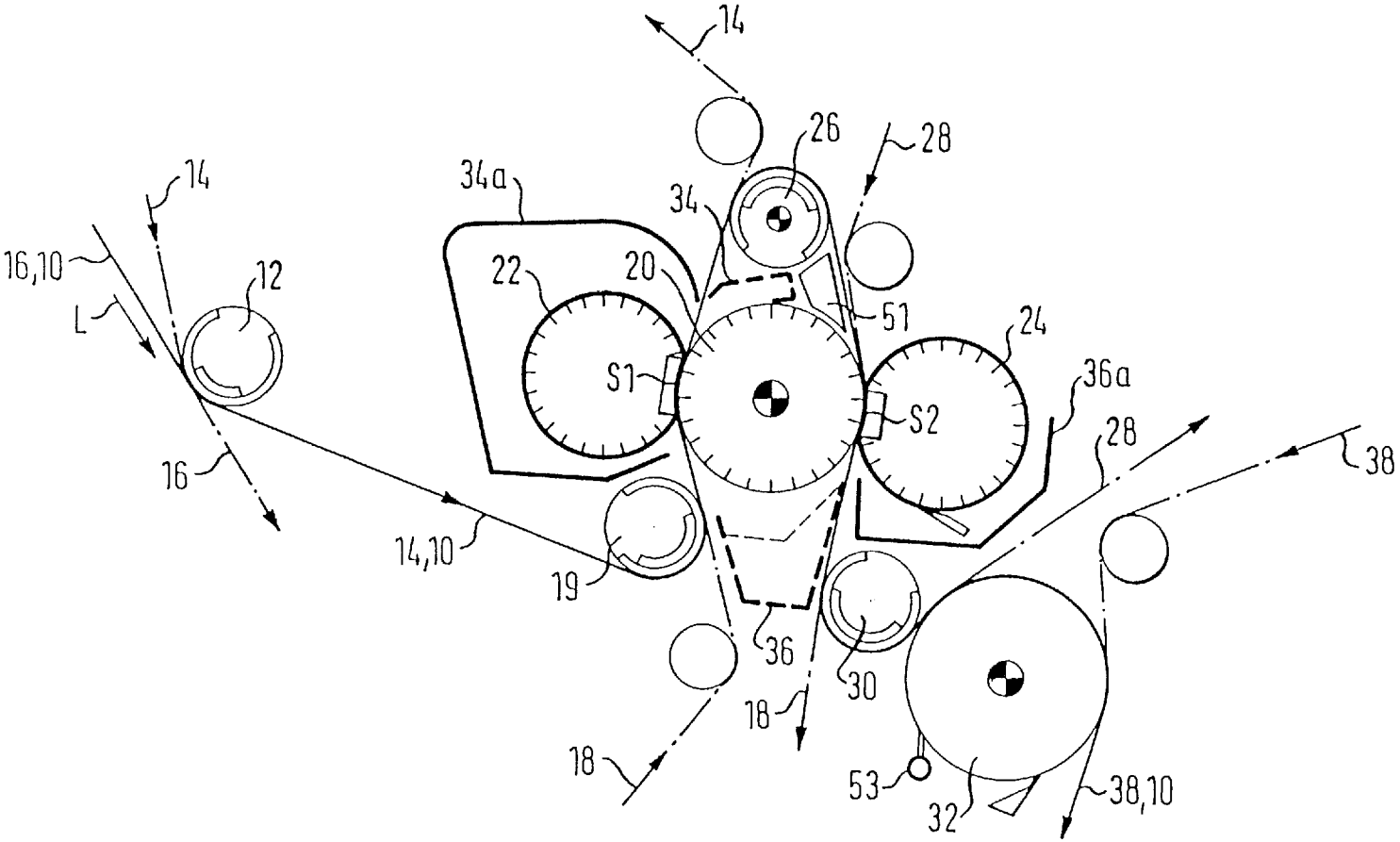
FIG. 1 illustrates a schematic, partially sectioned view of an exemplary embodiment of a press arrangement having two elongated press nips.

In a purely schematic, partially sectioned rendering, FIG. 1 shows an initial embodiment of a press arrangement for treating a fibrous material web 10, e.g., a paper or cardboard web.

In the area of a suction roll 12, fibrous material web 10 is taken over by (i.e., picked-up or transferred to) an upper felt 14 from a wire belt 16 and then fed, along with a lower felt 18, to an initial press nip S1, which is elongated in a web travel direction L. Fibrous material web 10, alone with lower felt 18, is then fed into a second press nip S2, which is elongated in web travel direction L. Before reaching first elongated press nip S1, fibrous material web 10, along with upper felt 14, is guided over a deflection roll 19, which is formed, e.g., as a suction roll. However, rolls 12 and 19 can also be brought together or combined into a single roll.

As shown in FIG. 1, elongated press nips S1 and S2 are formed between a central press roll 20 and two shoe press rolls 22 and 24 assigned thereto (associated therewith). Thus, central press roll 20 is arranged to serve as a shared counter-roll to shoe press rolls 22 and 24, which are positioned on opposite sides of central press roll 20.

Between elongated press nips S1 and S2, fibrous material web 10, along with lower felt 18, is guided around a deflection roll 26 designed, e.g., as a suction roll. Upper felt 14 can be separated from fibrous material web 10 in a vicinity of deflection roll 26.

In the exemplary embodiment, both the first and the second elongated press nips S1 and S2 are provided with two felts. To this end, a second upper felt 28 is guided through second elongated press nip S2 along with lower felt 18 and fibrous material web 10. Fibrous material web 10 and upper felt 28, after leaving second elongated press nip S2, can be guided over another deflection roll 30 designed, e.g, as a suction roll and can be led to a first drying cylinder 32 of a following dryer section. In the area of deflection roll 30, lower felt 18 can be separated from the fibrous material web 10.

To remove fibrous material web 10 from upper felt 28, drying cylinder 32 can preferably be provided with a closed or smooth surface. Fibrous material web 10, after leaving drying cylinder 32, can be conducted or transferred to a drying screen 38. To ensure the safe transfer of paper web 10, deflection roll 30 and drying cylinder 32 can be arranged to form a nip, i.e., these rolls can be pressed against each other.

As a result, a completely closed guidance system is provided for web 10. In particular, the closed guidance system is provided from the point at which upper felt 14, which simultaneously serves as a pick-up felt, takes up fibrous material web 10 from wire belt 16, to the point at which web 10 is passed on to the dryer section.

The dewatering of elongated press nips S1 and S2 occurs at least in part by swirling or spinning off the water in channels 34 and 34*a*, and 36 and 36*a*. To facilitate this swirling or spinning off of water, central press roll 20 and/or a press jacket of at least one of shoe press rolls 22 and 24 can be provided with, e.g., a blind-bored and/or grooved surface.

Rolls 20, 32, and 26 are motor-driven, and a spray pipe 53 is provided in the area of drying cylinder 32.

Figure 2:
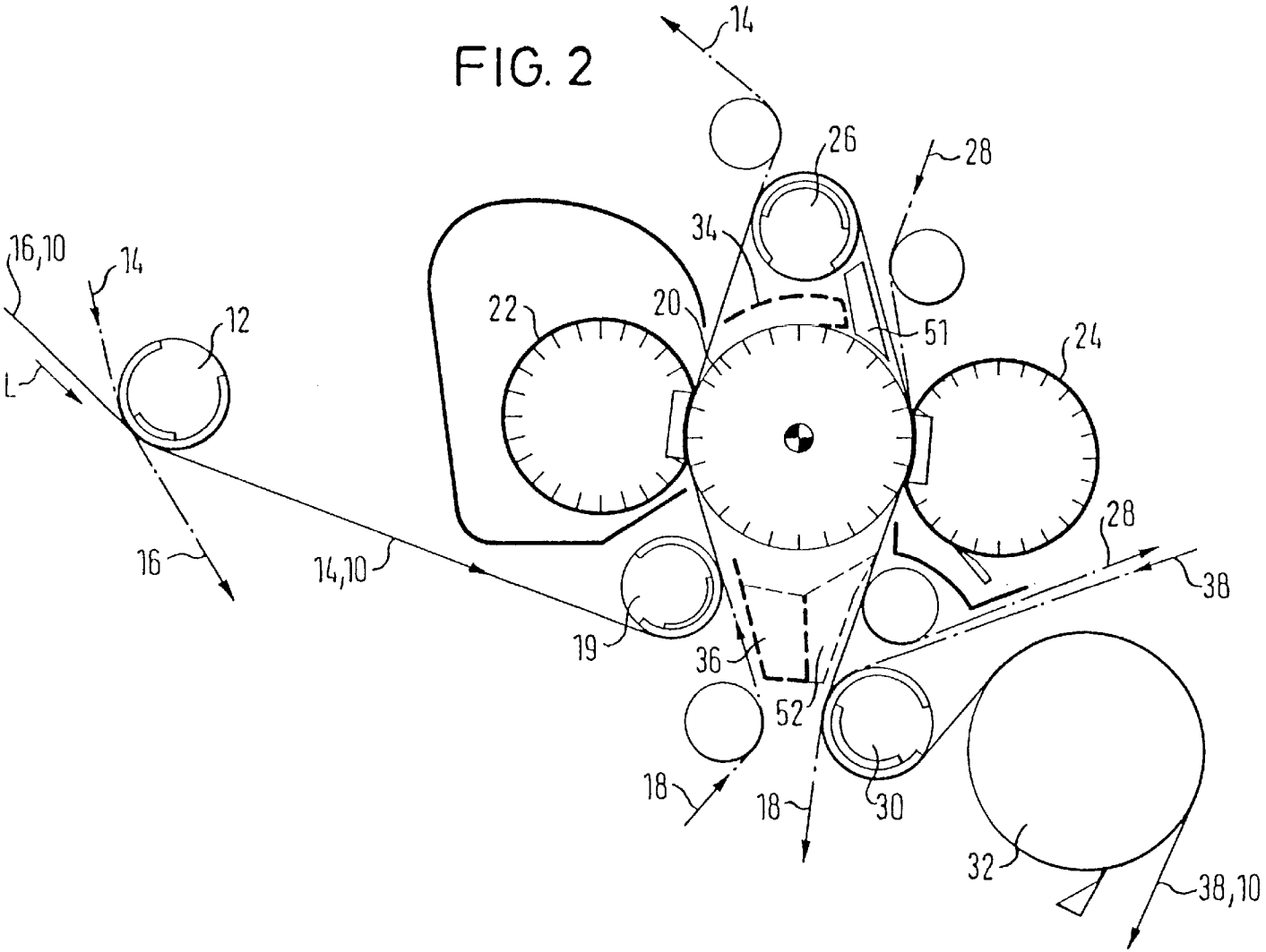
FIG. 2 illustrates a schematic, partially sectioned view of an alternative embodiment of a press arrangement having two elongated press nips.

FIG. 2 provides a schematic, partially sectioned depiction of another embodiment of a press arrangement with shoe press rolls 22 and 24 assigned to (associated with) a shared counter-roll 20.

This alternative embodiment differs from the one depicted in FIG. 1 primarily in that a web separating device 52 may be arranged to separate upper felt 28 from fibrous material web 10 before reaching deflection roll 30, e.g., a suction roll. Another variant is that fibrous material web 10 continues to be conducted on lower felt 18 until it is removed from lower felt 18, e.g., in a vicinity of deflection roll 30, by a drying screen 38 arranged to wind around deflection roll 30. Following deflection roll 30, fibrous material web 10 can be fed or guided by drying screen 38 to drying cylinder 32 of a neighboring dryer section.

Otherwise, this embodiment basically exhibits the same structure as the embodiment according to FIG. 1. Therefore, corresponding parts are identified with identical reference characters.

Figure 3:
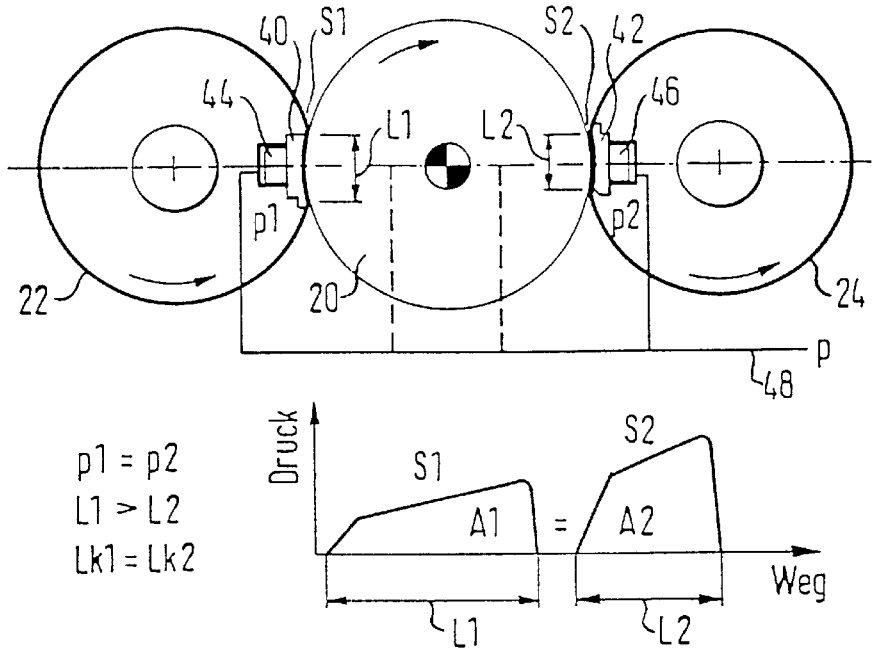
FIG. 3 illustrates an exemplary control system for the press arrangements depicted in FIGS. 1 and 2.

FIG. 3 provides a purely schematic depiction of an exemplary control system for the press arrangements depicted in FIGS. 1 and 2. Here, supporting devices 44 and 46, assigned to (associated with) press shoes 40 and 42 of shoe press rolls 22 and 24 can be subjected to same pressures p1 and p2. To this end, supporting devices 44 and 46 can be attached to a common line 48 providing the same pressure p. In this exemplary case, a length L1 of first elongated press nip S1 can be greater than a length L2 of second elongated press nip S2. Moreover, line forces Lk1 and Lk2 can be of equal magnitude, however, specific maximal pressures can differ. In accordance with this arrangement, press roll bearings of central press roll 20 are acted on only by the roll weight.

The pressure profiles for press nips S1 and S2 that result from the utilization of the above-described control system are schematically depicted in the lower portion of FIG. 3.

Figure 4:
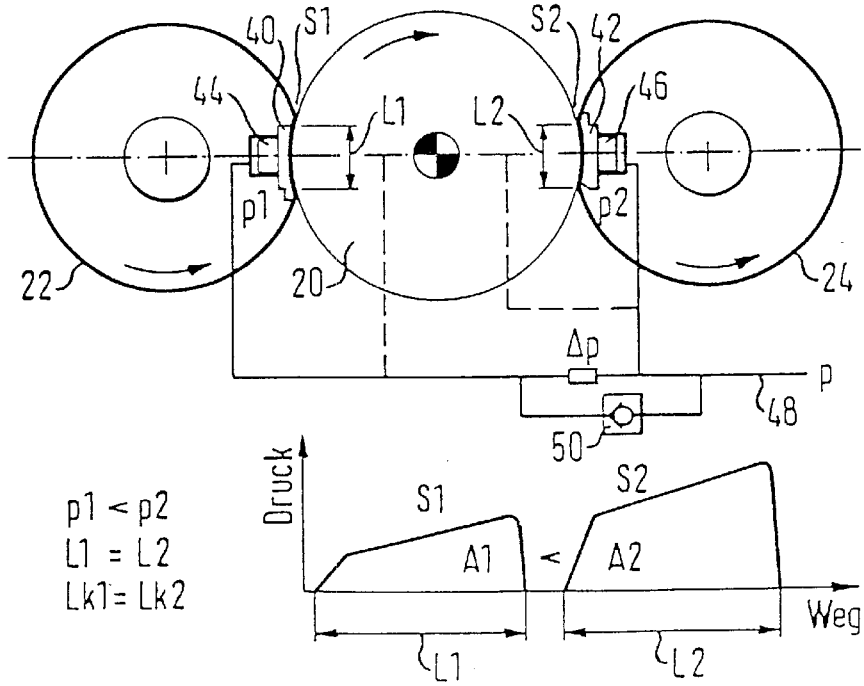
FIG. 4 illustrates an alternative exemplary control system for the press arrangements.

FIG. 4 shows an alternative exemplary control system for a press arrangement. In this exemplary arrangement, a pressure p1 can be applied to supporting device 44 assigned to (associated with) press shoe 40 of first shoe press roll 22 which is lower than a pressure p2 applied to supporting device 46 assigned to (associated with) press shoe 42 of second shoe press roll 24. Elongated press nips S1 and S2 can have a same length L1 and L2, whereby L1=L2, and line force Lk1 may be less than line force Lk2. Via a pressure reduction valve 50 provided in line 48, it is possible to separately and independently adjust pressures p1 and p2. In this way, the press roll bearings of central press roll 20 are acted on only by the differential line force and the roll weight.

The pressure profiles on press nips S1 and S2 resulting from the above-noted alternative control system are schematically depicted in the lower portion of FIG. 4.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

LIST OF REFERENCE CHARACTERS

| LIST OF REFERENCE CHARACTERS | |
|---|---|
| 10 | fibrous material web |
| 12 | suction roll |
| 14 | upper felt |
| 16 | wire belt |
| 18 | lower felt |
| 19 | deflection roll |
| 20 | central press roll |
| 22 | shoe press roll |
| 24 | shoe press roll |
| 26 | deflection roll |
| 28 | upper felt |
| 30 | deflection roll |
| 32 | drying cylinder |
| 34, 34a | groove |
| 36, 36a | groove |
| 38 | drying screen |
| 40 | press shoe |
| 42 | press shoe |
| 44 | supporting device |
| 46 | supporting device |
| 48 | line |
| 50 | valve |
| 51 | web-supporting aspirator |
| 52 | web-separating device |
| 53 | spray pipe |
| L | direction of web travel |
| L1 | nip length |
| L2 | nip length |
| Lk1 | line force |
| Lk2 | line force |
| S1 | first elongated press nip |
| S2 | second elongated press nip |
| p | pressure |
| p1 | pressure |
| p2 | pressure |

What is claimed:

1. A press arrangement for treating a fibrous material web comprising:

two shoe press rolls;

a counter-roll, associated with said two shoe press rolls, positioned to form a first and a second press nip with said two shoe press rolls, said first and said second press nip being elongated in a web travel direction; and a plurality of felts, wherein two of said plurality of felts are guided through at least said first press nip.

2. The press arrangement according to claim 1, wherein said two shoe press rolls are positioned on opposite sides of said counter-roll.

3. The press arrangement according to claim 1, wherein two of said plurality of felts are guided through said second press nip.

4. The press arrangement according to claim 1, wherein said plurality of felts is at most three felts.

5. The press arrangement according to claim 1, wherein said press arrangement is a closed web guidance system.

6. The press arrangement according to claim 1, wherein one of said plurality of felts is guided through both of said first and said second press nips.

7. The press arrangement according to claim 1, further comprising a deflection roll being positioned such that the material web, between said first and said second press nip, is guided around said deflection roll.

8. The press arrangement according to claim 7, wherein said deflection roll comprises a suction roll.

9. The press arrangement according to claim 7, wherein the material web is guided over said deflection roll by at least one of said plurality of felts.

10. The press arrangement according to claim 1, wherein one of said plurality of felts guided through said first press nip is also arranged as a pick-up felt.

11. The press arrangement according to claim 1, further comprising a deflection roll, wherein, following said second press nip, the fibrous material web is guided by said deflection roll.

12. The press arrangement according to claim 11, wherein said deflection roll comprises a suction roll.

13. The press arrangement according to claim 11, wherein said deflection roll is arranged to guide the fibrous material web to an adjacent dryer section.

14. The press arrangement according to claim 11, further comprising a smooth roll, wherein one of said plurality of felts is arranged as an upper felt and is guided through said second press nip, and wherein said smooth roll is arranged to separate the material web from said upper felt.

15. The press arrangement according to claim 11, further comprising a dryer screen that wraps around said deflection roll, wherein another one of the plurality of felts is arranged as a lower felt and is arranged to guide the fibrous material web out of the second press nip, said dryer screen being positioned to separate the fibrous material web form said lower felt in a vicinity of said deflection roll.

16. The press arrangement according to claim 1, wherein said counter-roll is at least one of blind-bored and grooved.

17. The press arrangement according to claim 1, wherein at least one of said counter-roll and at least one jacket of said two shoe press rolls includes at least one of at least one bore and at least one groove, wherein dewatering of said first and said second press nip is performed at least in part by spinning off water in said at least one at least one bore and at least one groove.

18. The press arrangement according to claim 1, wherein each of said two press shoe rolls comprising at least one press shoe and at least one supporting device associated with said at least one press shoe, wherein a length of said at least one press shoe forming said first press nip is greater than a length of said at least one press shoe forming said second press nip, and wherein a same pressure is applied to said at least one supporting device in both of said two shoe press rolls.

19. The press arrangement according to claim 1, wherein each of said two press shoe rolls comprising at least one press shoe and at least one supporting device associated with said at least one press shoe, wherein a length of said at least one press shoe forming said first press nip is the same as a length of said at least one press shoe forming said second press nip, and wherein a pressure applied to said at least one supporting device adapted to form said first press nip is lower than a pressure applied to said at least one supporting device adapted to form said second press nip.

20. The press arrangement according to claim 1, wherein at least one of said two shoe press rolls comprises at least one of a blind-bored and grooved press jacket.

21. The press arrangement according to claim 1, wherein the counter-roll is an inwardly supported roll with pressures corresponding to pressures in said first and said second press nips.

22. The press arrangement according to claim 1, further comprising an aspirating deflection roll and a web-supporting aspirator, wherein said web-supporting aspirator is positioned between said aspirating deflection roll and said second press nip, and wherein one of said plurality of felts is arranged as a lower felt, and said web-supporting aspirator is positioned to secure the fibrous material web to said lower felt.

23. The press arrangement according to claim 22, wherein said aspirated deflection roll has an adjustable drive.

24. The press arrangement according to claim 23, wherein the aspirated deflection roll and said adjustable drive are braked, whereby felt tension is increased in front of said second press nip.

25. The press arrangement according to claim 1, wherein said fibrous material web comprises one of a paper web and a cardboard web.

26. The press arrangement according to claim 1, wherein said counter-roll is arranged as a central press roll.

27. A press arrangement for treating a fibrous material web comprising:

two shoe press rolls;

a counter-roll, associated with said two shoe press rolls, positioned to form a first and a second press nip with said two shoe press rolls, said first and said second press nip being elongated in a web travel direction, and said counter-roll being arranged as a central press roll;

three felts, wherein two of said three felts are guided through at least said first nip, wherein two of said three felts are guided through said second press nip, and wherein one of said three felts is guided through both of said first and said second press nips;

said two shoe press rolls being positioned on opposite sides of said counter-roll, wherein said press arrangement is a closed web guidance system.

28. The press arrangement according to claim 27, wherein each of said two press shoe rolls comprising at least one press shoe and at least one supporting device associated with said at least one press shoe, wherein a length of said at least one press shoe forming said first press nip is greater than a length of said at least one press shoe forming said second press nip, and wherein a same pressure is applied to said at least one supporting device in both of said two shoe press rolls.

29. The press arrangement according to claim 27, wherein each of said two press shoe rolls comprising at least one press shoe and at least one supporting device associated with said at least one press shoe, wherein a length of said at least one press shoe forming said first press nip is the same as a length of said at least one press shoe forming said second press nip, and wherein a pressure applied to said at least one supporting device adapted to form said first press nip is lower than a pressure applied to said at least one supporting device adapted to form said second press nip.

* * * * *